US006639453B2

(12) United States Patent
Nishimura et al.

(10) Patent No.: US 6,639,453 B2
(45) Date of Patent: Oct. 28, 2003

(54) ACTIVE BIAS CIRCUIT HAVING WILSON AND WIDLAR CONFIGURATIONS

(75) Inventors: Yoshikazu Nishimura, Tokyo (JP); Fuminobu Ono, Tokyo (JP)

(73) Assignee: NEC Compound Semiconductor Devices, Ltd., Kanagawa (JP)

( * ) Notice: Subject to any disclaimer, the term of this patent is extended or adjusted under 35 U.S.C. 154(b) by 0 days.

(21) Appl. No.: 09/794,698

(22) Filed: Feb. 26, 2001

(65) Prior Publication Data

US 2001/0019287 A1 Sep. 6, 2001

(30) Foreign Application Priority Data

Feb. 28, 2000 (JP) ..... 2000-052599

(51) Int. Cl.[7] ..... G05F 1/10
(52) U.S. Cl. ..... 327/543; 327/538; 327/540
(58) Field of Search ..... 323/312, 313, 323/315, 316; 330/288; 327/543, 538, 541, 530, 546

(56) References Cited

U.S. PATENT DOCUMENTS

| | | | | |
|---|---|---|---|---|
| 4,558,242 A | | 12/1985 | Tuthill et al. | 327/437 |
| 4,780,624 A | * | 10/1988 | Nicollini et al. | 327/541 |
| 4,859,929 A | | 8/1989 | Raguet | 323/316 |
| 5,777,509 A | * | 7/1998 | Gasparik | 327/542 |
| 5,859,560 A | * | 1/1999 | Matthews | 327/513 |
| 5,955,874 A | * | 9/1999 | Zhou et al. | 323/315 |
| 6,191,646 B1 | * | 2/2001 | Shin | 327/543 |
| 6,204,724 B1 | * | 3/2001 | Kobatake | 327/541 |

FOREIGN PATENT DOCUMENTS

| | | |
|---|---|---|
| JP | 58198911 | 11/1983 |
| JP | 61292405 | 12/1986 |
| JP | 05276015 | 10/1993 |
| JP | 06244659 | 9/1994 |

* cited by examiner

*Primary Examiner*—Tuant T. Lam
*Assistant Examiner*—Hiep Nguyen
(74) *Attorney, Agent, or Firm*—Scully, Scott, Murphy & Presser

(57) ABSTRACT

An active bias circuit having a combined configuration of the Wilson and Widlar current source configurations is provided, which makes it possible to set the output bias voltage at approximately 0V even if a reference voltage applied to generate a reference current does not reach 0V. This circuit comprises cascode-connected first and second transistors, cascode-connected third and fourth transistors, and a diode with a specific forward voltage drop generated by a current flowing through the diode itself. The absolute value of the output bias voltage is decreased by the value of the forward voltage drop of the diode compared with the case where the diode is not provided. The diode is provided between the source/emitter of the third transistor and the drain/collector of the fourth transistor, or between the connection point of the third and fourth transistors and the output terminal, or the gates/bases of the first and third transistors.

4 Claims, 7 Drawing Sheets

ACTIVE BIAS CIRCUIT HAVING WILSON AND WIDLAR CONFIGURATIONS

BACKGROUND OF THE INVENTION

1. Field of the Invention

The present invention relates to an active bias circuit and more particularly, to an active bias circuit with a combined configuration of the Wilson configuration for current source and the Widlar configuration for current source.

2. Description of the Related Art

FIG. 1 shows a conventional active bias circuit 10 having a combined configuration of the Wilson and Widlar current source configurations. As shown in FIG. 1, this bias circuit 10 comprises four n-channel Metal-Oxide-Semiconductor Field-Effect Transistors (MOSFETs) M11, M12, M13, and M14 and a resistor R11.

Each of the MOSFETs M11 and M14 has a so-called diode connection. Thus, the gate and the drain of the MOSFET 11 are coupled together at the point P1 and the gate and the drain of the MOSFET 14 are coupled together at the point P2. The drain of the MOSFET M11 is connected to the terminal T1 by way of the resistor R11 while the gate of the MOSFET M11 is connected to the gate of the MOSFET M13. The source of the MOSFET M11 is connected to the drain of the MOSFET M12. The gate and the source of the MOSFET M12 are connected to the gate and the source of the MOSFET M14, respectively. The coupled sources of the MOSFETs M12 and M14 are connected to the ground. Thus, the MOSFETs M11 and M12 located at the input side are connected in cascode.

The drain and the source of the MOSFET M13 are connected to the terminal T2 and the drain of the MOSFET M14, respectively. The output terminal T3 of the active bias circuit 10 is connected to the point P2 at which the gate and the drain of the MOSFET M14 are coupled together. Thus, the MOSFETs M13 and M14 located at the output side also are connected in cascode.

A reference voltage $V_1$ is applied to the terminal T1, thereby generating a reference current $I_{REF}$ flowing through the resistor R11. In other words, the reference current $I_{REF}$ is generated by the reference voltage $V_1$ and the resistor R11. Since it can be considered that no gate current flows to the gates of the MOSFETs M11 and M13, the reference current $I_{REF}$ is equal to the drain current $I_{D11}$ of the MOSFET M11 and to the drain current $I_{D12}$ of the MOSFET M12 (i.e., $I_{REF}=I_{D11}=I_{D12}$).

A bias voltage $V_2$ is applied to the terminal T2, thereby generating the drain current $I_{D13}$ of the MOSFET M13. The value of the drain current $I_{D13}$ has a specific ratio with respect to that of the reference current $I_{REF}$. Specifically, the value of the drain current $I_{D13}$ is a times as much as that of the reference current $I_{REF}$, where a is a positive constant (i.e., $I_{D13}=aI_{REF}$). Since it can be considered that no gate current flows to the gates of the MESFETs M12 and M14, the drain current $I_{D13}$ is equal to the drain current $I_{D14}$ of the MOSFET M14 (i.e., $I_{D13}=I_{D14}$).

The output bias voltage $V_{OUT}$ of the conventional bias circuit 10 is generated at the output terminal T3. The output bias voltage $V_{OUT}$ is equal to the voltage at the connection point P2 of the gate and the drain of the MOSFET M14 (i.e., the connection point of the drain of the MOSFET M14 and the source of the MOSFET M13).

A target circuit 20, to which the output bias voltage $V_{OUT}$ is applied from the active bias circuit 10, includes an n-channel enhancement MOSFET M15. The gate of the MOSFET M15 is connected to the output terminal T3 of the circuit 10, receiving the bias voltage $V_{OUT}$ of the circuit 10. The drain of the MOSFET M15 is connected to the terminal T4 to which a voltage $V_D$ is applied. The source of the MOSFET M15 is connected to the ground.

Although the target circuit 20 includes other active elements and other passive elements along with the MOSFET M15, they are omitted in FIG. 1 for the sake of simplification.

The conventional active bias circuit 10 of FIG. 1 operates in the following way.

If the value of the reference resistor R11 is suitably determined or adjusted according to the value of the reference voltage $V_1$ (e.g., 2V), the value of the reference current $I_{REF}$ flowing through the MOSFET M11 can be set as desired. Also, due to the reference current $I_{REF}$ thus set, the value of the voltage $V_{P1}$ at the connection point P1 (i.e., the connection point of the resistor R11 and the drain of the MOSFET M11) is determined. In this case, the value of the voltage $V_{P2}$ at the connection point P2 (i.e., the output terminal T3) is given as the difference of the forward voltage drop $V_{FM13}$ of the MOSFET M13 from the value of the bias voltage $V_2$ applied to the terminal T2. Thus, the following equation (1) is established.

$$V_{P2}=V_{OUT}=V_2-V_{FM13} \quad (1)$$

Thus, when the value of the reference voltage $V_{REF}$ applied to the terminal T1 (i.e., the reference current $I_{REF}$) is changed, the values of the drain current $I_{D13}$ of the MOSFET M13 and the forward voltage drop $V_{FM13}$ thereof are changed, resulting in change of the output bias voltage $V_{OUT}$. This means that even if the bias voltage $V_2$ is not changed, the output bias voltage $V_{OUT}$ can be changed by changing the reference voltage $V_1$.

The value of the drain current $I_{D15}$ of the MOSFET M15 varies according to the value of the output bias voltage $V_{OUT}$ applied to the gate of the MOSFET M15 in the target circuit 20. Since the MOSFET M15 is of the enhancement type, the value of the drain current $I_{D15}$ of the MOSFET M15 can be set as zero (0V) if the value of the output bias voltage $V_{OUT}$ is set to be equal to or lower than the threshold voltage of the MOSFET M15. Thus, the MOSFET M15 can be cut off.

The operation of the bias circuit 10 shown in FIG. 1 scarcely fluctuates even if the threshold voltages $V_{th}$ of the MOSFETS M11, M12, M13, and M14 fluctuate due to change of the various parameters in their fabrication process sequence and/or the ambient temperature of the circuit 10 varies during operation. In other words, as long as the parameters of the circuit 10 are kept unchanged, the value of the drain current $I_{D15}$ of the MOSFET M15 in the target circuit 20 is kept approximately constant in spite of the fluctuation of the threshold voltage and the ambient temperature.

For example, when the absolute value (i.e., amplitude) of the threshold voltages $V_{th}$ of the MOSFETs M11, M12, M13, and M14 decreases, the value of the reference current $I_{REF}$ increases according to the decrease of the threshold voltages $V_{th}$, lowering the voltage $V_{P1}$ at the point P1. On the other hand, according to the increase of the reference current $I_{REF}$, the drain current $I_{D13}$ of the MOSFET M13 increases, which increases the voltage drop generated by the MOSFET M13. As a result, the value of the voltage $V_{P2}$ at the point P2 (i.e., the output bias voltage $V_{OUT}$) decreases.

On the contrary, when the absolute value (i.e., amplitude) of the threshold voltages $V_{th}$ of the MOSFETs M11, M12, M13, and M14 increases, the value of the reference current $I_{REF}$ decreases according to the increase of the threshold voltages $V_{th}$, raising the voltage $V_{P1}$ at the point P1. On the other hand, according to the decrease of the reference current $I_{REF}$, the drain current $I_{D13}$ of the MOSFET M13 decreases, which decreases the voltage drop generated by the MOSFET M13. As a result, the value of the voltage $V_{P2}$ at the point P2 (i.e., the output bias voltage $V_{OUT}$) increases.

With the conventional bias circuit 10, in the above-described manner, the drain currents $I_{D13}$ and $I_{D14}$ of the MOSFETs M13 and M14 (and therefore, the drain current $I_{D15}$ of the MOSFET M15) are kept approximately constant against the fluctuation of the threshold voltages $V_{th}$.

The bias circuit 10 operates in the same way as above when the ambient temperature varies as well. Therefore, the drain current $I_{D15}$ of the MOSFET M15 is kept approximately constant against the fluctuation of the ambient temperature.

However, the above-described conventional active bias circuit 10 has the following problems.

Specifically, with the conventional circuit 10, the power consumption of the target circuit 20 (i.e., the MOSFET M15) can be adjusted by changing the value of the reference voltage $V_1$ applied to the terminal T1. This is due to the fact that the output bias voltage $V_{OUT}$ varies according to the change of the reference voltage $V_1$, which changes the drain current $I_{D15}$ of the MOSFET M15.

The bias circuit 10 is used, for example, for applying a desired bias voltage to an amplifier circuit provided in a mobile telephone. In this case, the target circuit 20 is the amplifier circuit.

With mobile telephones, generally, the voltage $V_D$ is supplied to the MOSFET M15 and at the same time, the output bias voltage $V_{OUT}$ with a desired value is supplied to the MOSFET M15 and the target circuit 20 (i.e., the amplifier circuit) by the bias circuit 10 in the normal operation. On the other hand, in the power-saving operation, the supply of the voltage $V_D$ to the MOSFET M15 is stopped with a switch (e.g., a so-called drain switch, not shown in FIG. 1) to stop temporarily the operation of the MOSFET M15 (and the circuit 20).

Thus, there is a problem that the count (i.e., total number) of the necessary parts increases because the drain switch is essentially provided. Also, there is another problem that the lifetime of the battery is shortened because the operation of the drain switch consumes some electric power.

If the drain switch can be eliminated, these two problems are easily solved. This is realized by, for example, setting the output bias voltage $V_{OUT}$ of the bias circuit 10 to be lower than the threshold voltage of the MOSFET M15, thereby stopping the operation of the MOSFET 15 and the target circuit 20. However, some mobile telephones have a configuration that does not permit the reference voltage $V_1$ of 0 V. In this case, it is unable to set the output bias voltage $V_{OUT}$ of the circuit 10 to be lower than the threshold voltage of the MOSFET M15, making the MOSFET M15 cut off.

Moreover, with the conventional bias circuit 10, the output bias voltage $V_{OUT}$ is unable to be sufficiently low. As a result, it is impossible or difficult for the MOSFET M15 to consume less electric power as desired when the MOSFET M15 is operated at a low supply voltage. In other words, there is a problem that the variable range of power consumption of the MOSFET M15 by the reference voltage $V_1$ is narrow.

In addition, the Japanese Non-Examined Patent Publication Nos. 61-292405 published in 1986, 5-276015 published in 1993, 6-244659 published in 1994, and 4-61524 published in 1992 disclose the techniques that the voltage level is changed with the use of a diode or diodes. However, these techniques have no relationship with the active bias circuit of the type with a combined configuration of the Wilson and Widlar current source configurations.

SUMMARY OF THE INVENTION

Accordingly, an object of the present invention is to provide an active bias circuit that expands the variable range of power consumption of a target circuit that varies by changing the value of a reference voltage.

Another object of the present invention is to provide an active bias circuit that makes it possible to cut off a current flowing in a target circuit including an enhancement active element or device.

The above objects together with others not specifically mentioned will become clear to those skilled in the art from the following description.

An active bias circuit according to the present invention comprises:

(a) a first transistor with a diode connection;
  the first transistor being supplied with a reference current by way of a resistor;
  the first transistor having a control terminal;

(b) a second transistor connected in cascode to the first transistor;
  the second transistor having a control terminal;

(c) a third transistor having a control terminal connected to the control terminal of the first transistor;
  a constant current with a specific ratio with respect to the reference current flowing through the third transistor;

(d) a fourth transistor with a diode connection;
  the fourth transistor being connected in cascode to the third transistor;
  the fourth transistor having a control terminal connected to the control terminal of the second transistor;

(e) an output terminal formed between the third and fourth transistors connected in cascode;
  an output bias voltage being derived from the output terminal;
  the output bias voltage varying according to a reference voltage applied across the first and second transistors connected in cascode; and (f) a diode with a specific forward voltage drop generated by a current flowing through the diode itself;
  an absolute value of the output bias voltage being decreased by a value of the forward voltage drop of the diode.

With the active bias circuit according to the present invention, the diode with a specific forward voltage drop is provided. Utilizing the forward voltage drop of the diode, the absolute value of the output bias voltage is decreased by the value of the forward voltage drop. Thus, the current flowing through a target circuit to be supplied with the bias voltage from the active bias circuit can be cut off without any dedicated switch for current cut-off.

Also, the absolute value of the output bias voltage is smaller than that of the bias voltage applied across the third and fourth transistors connected in cascode by the value of the forward voltage drop of the diode. Therefore, the variable range of power consumption of a target circuit that varies by changing the value of the reference voltage can be expanded toward the low-value side.

In a preferred embodiment of the invention, the diode is connected between the third transistor and the output terminal in such a way that a forward direction of the diode and a direction of the constant current flowing through the third transistor are the same.

In another preferred embodiment of the invention, the diode is connected to the output terminal and a connection point of the third transistor and the fourth transistor, thereby decreasing the absolute value of the output bias voltage by the value of the forward voltage drop of the diode.

In still another preferred embodiment of the invention, one of an anode and a cathode of the diode is connected to the connection point of the first transistor and the other thereof is connected to the connection point of the second transistor, thereby decreasing the absolute value of the output bias voltage by the value of the forward voltage drop of the diode.

In a still further preferred embodiment of the invention, the active bias circuit is so designed that the output bias voltage is applied to a control terminal of a voltage-driven active element operable in an enhanced mode provided in a target circuit.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
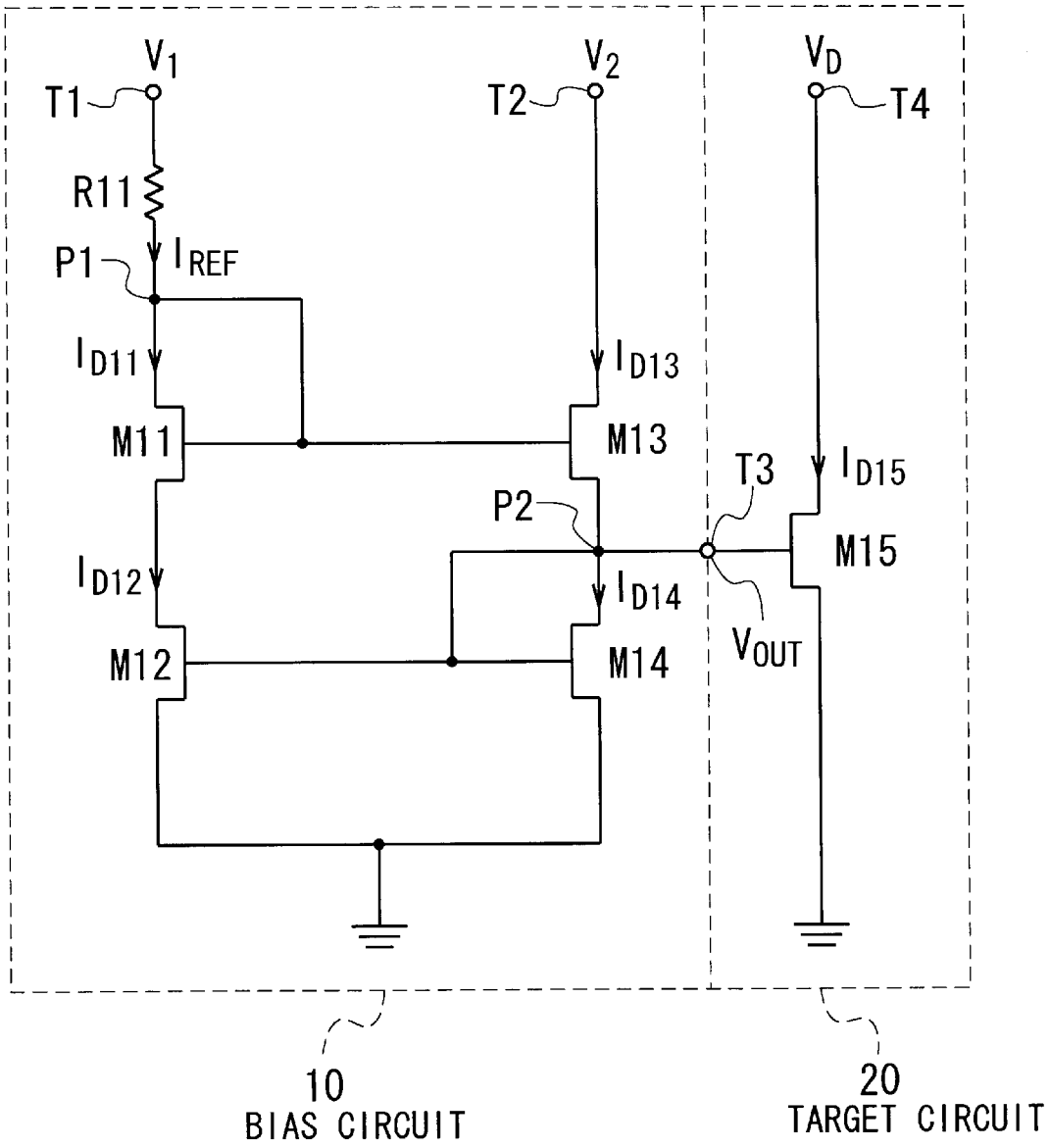
FIG. 1 PRIOR ART
FIG. 1 is a circuit diagram showing the configuration of a conventional active bias circuit.

Preferred embodiments of the present invention will be described in detail below while referring to the drawings attached.

First Embodiment

Figure 2:
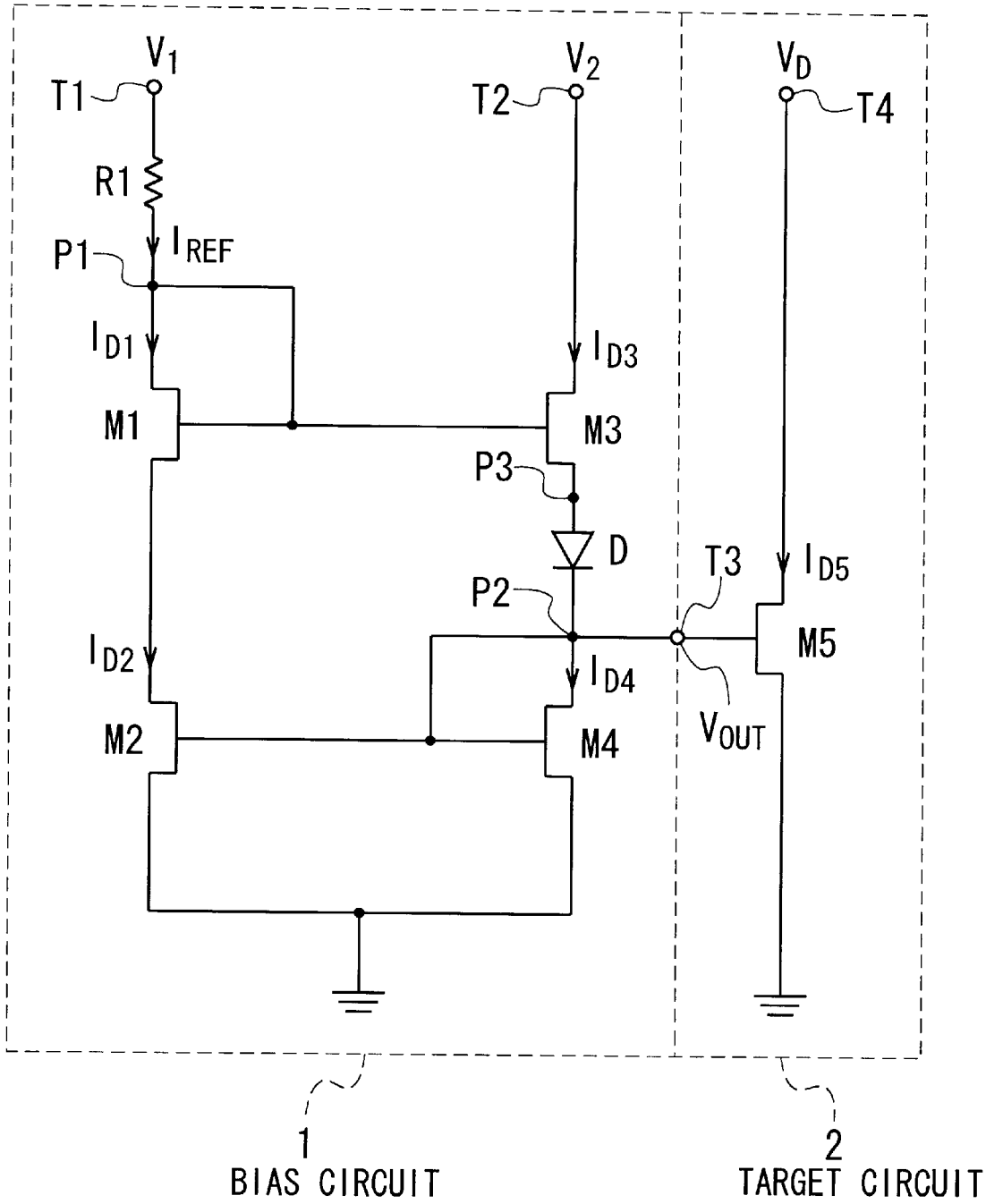
FIG. 2 is a circuit diagram showing the configuration of an active bias circuit according to a first embodiment of the invention.

As shown in FIG. 2, an active bias circuit 1 according to a first embodiment of the invention has a combined configuration of the Wilson and Widlar current source configurations. This bias circuit 1 comprises four n-channel MOSFETs M1, M2, M3, and M4, a resistor R1, and a p-n junction diode D.

Each of the MOSFETs M1 and M4 has a so-called diode connection. Thus, the gate and the drain of the MOSFET 1 are coupled together at the point P1 and the gate and the drain of the MOSFET 4 are coupled together at the point P2. The drain of the MOSFET M1 is connected to the terminal T1 by way of the resistor R1 while the gate of the MOSFET M1 is connected to the gate of the MOSFET M3. The source of the MOSFET M1 is connected to the drain of the MOSFET M2. The gate and the source of the MOSFET M2 are connected to the gate and the source of the MOSFET M4, respectively. The coupled sources of the MOSFETs M2 and M4 are connected to the ground. Thus, the MOSFETs M1 and M2 located at the input side are connected in cascode.

The drain of the MOSFET M3 is connected to the terminal T2. The source of the MOSFET M3 is connected to the drain of the MOSFET M4 by way of the diode D. The cathode of the diode D is connected to the connection point P2 of the gate and drain of the MOSFET M4. The anode of the diode D is connected to the point P3 connected to the source of the MOSFET M3. The output terminal T3 of the active bias circuit 1 is connected to the point P2. Thus, the MOSFETs M3 and M4 located at the output side also are connected in cascode by way of the diode D.

A reference voltage $V_1$ is applied to the terminal T1, thereby generating a reference current $I_{REF}$ flowing through the resistor R1. In other words, the reference current $I_{REF}$ is generated by the reference voltage $V_1$ and the resistor R1. Since it can be considered that no gate current flows to the gates of the MESFETs M1 and M3, the reference current $I_{REF}$ is equal to the drain current $I_{D1}$ of the MOSFET M1 and to the drain current $I_{D2}$ of the MOSFET M2 (i.e., $I_{REF}=I_{D1}=I_{D2}$).

A bias voltage $V_2$ is applied to the terminal T2, thereby generating the drain current $I_{D3}$ of the MOSFET M3. The value of the drain current $I_{D3}$ has a specific ratio with respect to that of the reference current $I_{REF}$. Specifically, the value of the drain current $I_{D3}$ is a times as much as that of the reference current $I_{REF}$, where a is a positive constant (i.e., $I_{D3}=aI_{REF}$). Since the drain current $I_{D3}$ flows through the diode D to the MOSFET M4 and at the same time, it can be considered that no gate current flows to the gates of the MESFETs M2 and M4, the drain current $I_{D3}$ is equal to the drain current $I_{D4}$ of the MOSFET M4 (i.e., $I_{D3}=I_{D4}$).

The output bias voltage $V_{OUT}$ of the bias circuit 1 is generated at the output terminal T3. The output bias voltage $V_{OUT}$ is equal to the voltage $V_{P2}$ at the connection point P2 of the gate and the drain of the MOSFET M4. The source voltage of the MOSFET M3 (i.e., the voltage $V_{P3}$ at the point P3) is equal to the sum of the output bias voltage $V_{OUT}$ and the forward voltage drop of the diode D.

A target circuit 2, to which the output bias voltage $V_{OUT}$ is applied from the active bias circuit 1, includes an n-channel enhancement MOSFET M5. The gate of the MOSFET M5 is connected to the output terminal T3 of the bias circuit 1, receiving the bias voltage $V_{OUT}$ of the circuit 1. The drain of the MOSFET M5 is connected to the terminal T4 to which a voltage $V_D$ is applied. The source of the MOSFET M5 is connected to the ground. Thus, the gate-to-source voltage of the MOSFET M5 is equal to the output bias voltage $V_{OUT}$ of the circuit 1 and as a result, the drain current $I_{D5}$ of the MOSFET M5 increases or decreases according to the value of the output bias voltage $V_{OUT}$.

Although the target circuit 2 includes other active elements and other passive elements along with the MOSFET M 5, they are omitted in FIG. 2 for the sake of simplification.

The active bias circuit 1 according to the first embodiment, of FIG. 2 operates in the following way.

If the value of the reference resistor R1 is suitably determined or adjusted according to the specific value of the reference voltage $V_1$ (e.g., 2V), the value of the reference current $I_{REF}$ flowing through the MOSFET M1 can be set as desired. Also, due to the reference current $I_{RE}$ thus set, the value of the voltage $V_{P1}$ at the connection point P1 (i.e., the connection point of the resistor R1 and the drain of the MOSFET M1) is determined. In this case, the value of the voltage $V_{P2}$ at the connection point P2 (i.e., the output terminal T3) is given as the difference of the forward voltage drop $V_{FM3}$ of the MOSFET M3 and the forward voltage drop $V_{FD}$ of the diode D from the bias voltage $V_2$ applied to the terminal T2. Thus, the following equation (2) is established.

$$V_{P2}=V_{OUT}=V_2-(V_{FM13}+V_{FD}) \quad (2)$$

Accordingly, when the value of the reference voltage $V_{REF}$ applied to the terminal T1 (i.e., the reference current $I_{REF}$) is changed, the values of the drain current $I_{D3}$ of the MOSFET M3 and the sum of the forward voltage drops ($V_{FM3}+V_{FD}$) are changed, resulting in change of the output bias voltage $V_{OUT}$. This means that even if the bias voltage $V_2$ is not changed, the output bias voltage $V_{OUT}$ can be changed by changing the reference voltage $V_1$.

The value of the drain current $I_{D5}$ of the MOSFET M5 varies according to the value of the output bias voltage $V_{OUT}$ applied to the gate of the MOSFET M5 in the target circuit 2. Since the MOSFET M5 is of the enhancement type, the value of the drain current $I_{D5}$ of the MOSFET M5 can be set as zero (i.e., the MOSFET M5 can be cut off) if the value of the output bias voltage $V_{OUT}$ is set to be equal to or lower than the threshold voltage of the MOSFET M5. In other words, if the value of the output bias voltage $V_{OUT}$ is set at approximately 0V, the MOSFET M5 can be cut off.

In the active bias circuit 1 according to the first embodiment shown in FIG. 2, the diode D gives no effect to the operation of the circuit 1. Therefore, like the conventional active bias circuit 10 shown in FIG. 1, the bias circuit 1 operates stably even if the threshold voltages $V_{th}$ of the MOSFETs M1, M2, M3, and M4 fluctuate due to change of the various parameters in their fabrication process sequence and/or the ambient temperature of the circuit 1 varies during operation. In other words, as long as the parameters of the circuit 1 are kept unchanged, the value of the drain current $I_{D5}$ of the MOSFET M5 is kept approximately constant in spite of the fluctuation of the threshold voltage and the ambient temperature. This is the same as the conventional circuit of FIG. 1 and thus, no detailed explanation is omitted here.

As described above, with the active bias circuit 1 according to the first embodiment shown in FIG. 2, the diode D with the forward voltage drop $V_{FD}$ is provided between the source of the MOSFET M3 and the drain of the MOSFET M4, where the voltage drop $V_{FD}$ of the diode D is generated by the drain current $I_{D3}$ of the MOSFET M3. Therefore, the absolute value (i.e., amplitude) of the output bias voltage $V_{OUT}$, which is varied by the reference voltage $V_{REF}$ applied across the cascode-connected MOSFETs M1 and M2, is decreased by the value of the voltage drop $V_{FD}$ of the diode D, compared with the conventional bias circuit 10 of FIG. 1.

Consequently, even if the reference voltage $V_{REF}$ applied to generate the reference current $I_{REF}$ does not reach 0V, the absolute value of the output bias voltage $V_{OUT}$ can be set to be lower than the threshold voltage of the MOSFET M5. Thus, the current $I_{D5}$ flowing through the MOSFET M5 in the target circuit 2 can be cut off without any dedicated switch (i.e., drain switch) for current cut-off.

Also, the absolute value of the output bias voltage $V_{OUT}$ is smaller than that of the voltage $V_{P3}$ at the point P3 by the value of the voltage drop $V_{FD}$ of the diode D. Therefore, the variable range of power consumption of the target circuit 2 that varies by changing the value of the reference voltage $V_1$ can be expanded toward the low-value side.

A concrete example of the bias circuit 1 is as follows, which was confirmed by the inventor's test.

When the reference voltage $V_1$ is set at 0.2V and at the same time, the bias voltage $V_2$ and the voltage $V_D$ for the MOSFET M5 are set at 4V (i.e., $V_1$=0.2V, $V_2$=$V_D$=4V), the voltage $V_{P3}$ at the point P3 is approximately 0.1V. When the forward voltage drop $V_{FD}$ of the diode D is approximately 0.5V, even if the reference voltage $V_1$ is unable to be lowered to a value lower than approximately 0.2V, the drain current $I_{D5}$ of the MOSFET M5 can be set at 0V, thereby cutting the MOSFET M5 off.

Second Embodiment

Figure 3:
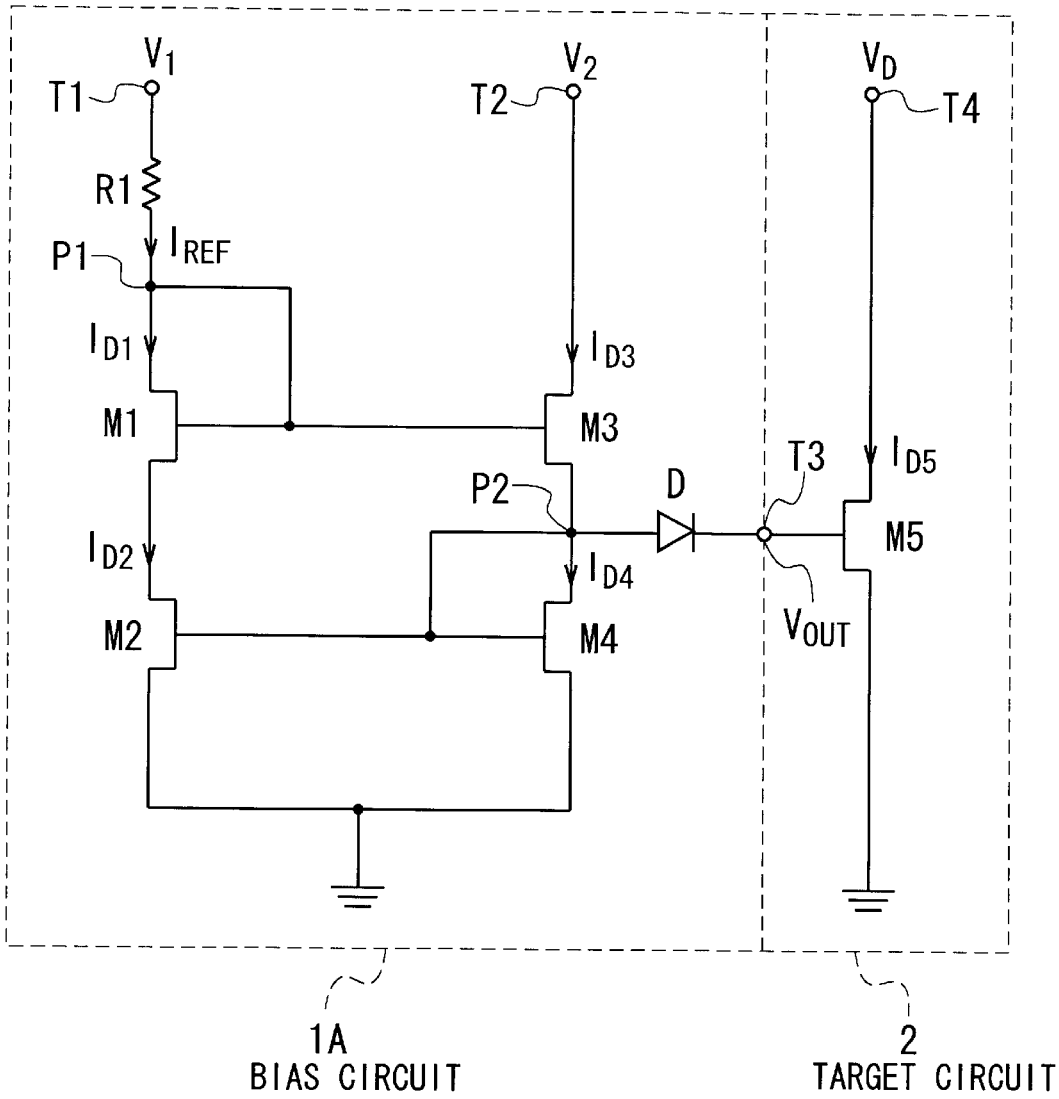
FIG. 3 is a circuit diagram showing the configuration of an active bias circuit according to a second embodiment of the invention.

FIG. 3 shows an active bias circuit 1A according to a second embodiment of the invention, which comprises the same configuration as the circuit 1 according to the first embodiment of FIG. 2, except that the p-n junction diode D is connected to the connection point P2 of the MOSFETs M3 and M4 and the output terminal T3. Therefore, the description about the same configuration is omitted here by attaching the same reference symbols as those in the first embodiment for the sake of simplification of description in FIG. 3.

The operation of the active bias circuit 1A according to the second embodiment of FIG. 3 is as follows.

If the value of the reference resistor R1 is suitably determined or adjusted according to the specific value of the reference voltage $V_1$ (e.g., 2V), the value of the reference current $I_{REF}$ flowing through the MOSFET M1 can be set as desired. Also, due to the reference current $I_{RE}$ thus set, the value of the voltage $V_{P1}$ at the connection point P1 is determined. In this case, the value of the voltage $V_{P2}$ at the connection point P2 is given as the difference of the forward voltage drop $V_{FM3}$ of the MOSFET M3 from the value of the bias voltage $V_2$ applied to the terminal T2. Thus, the following equation (3) is established.

$$V_{P2}=V_2-V_{FM3} \quad (3)$$

Also, in the bias circuit 1A, the diode D is located between the point P2 and the output terminal T3. Thus, a leakage current flows through the diode D from the point P2 to the gate of the MOSFET M5 in the target circuit 2, resulting in a forward voltage drop $V_{FD}$. Accordingly, the output bias voltage $V_{OUT}$ at the output terminal T3 is expressed by the following equation (4) using the voltage drop $V_{FD}$ of the diode D.

$$\begin{aligned} V_{OUT} &= V_{P2} - V_{FD} \\ &= V_2 - (V_{FM3} + V_{FD}) \end{aligned} \quad (4)$$

As clearly seen, the equation (4) is equal to the equation (2) appeared in the first embodiment. Thus, the active bias circuit 1A according to the second embodiment has the same advantages as those in the first embodiment.

A concrete example of the bias circuit 1A is as follows, which was confirmed by the inventor's test.

When the reference voltage $V_1$ is set at 0.2V and at the same time, the bias voltage $V_2$ and the voltage $V_D$ for the MOSFET M5 are set at 4V (i.e., $V_1$=0.2V, $V_2$=$V_D$=4V), the voltage $V_{P2}$ at the point P2 is approximately 0.1V. When the forward voltage drop $V_{FD}$ of the diode D is approximately 0.5V, even if the reference voltage $V_1$ is unable to be lowered to a value lower than approximately 0.2V, the drain current $I_{D5}$ of the MOSFET M5 can be set at 0V, thereby cutting the MOSFET M5 off.

Third Embodiment

Figure 4:
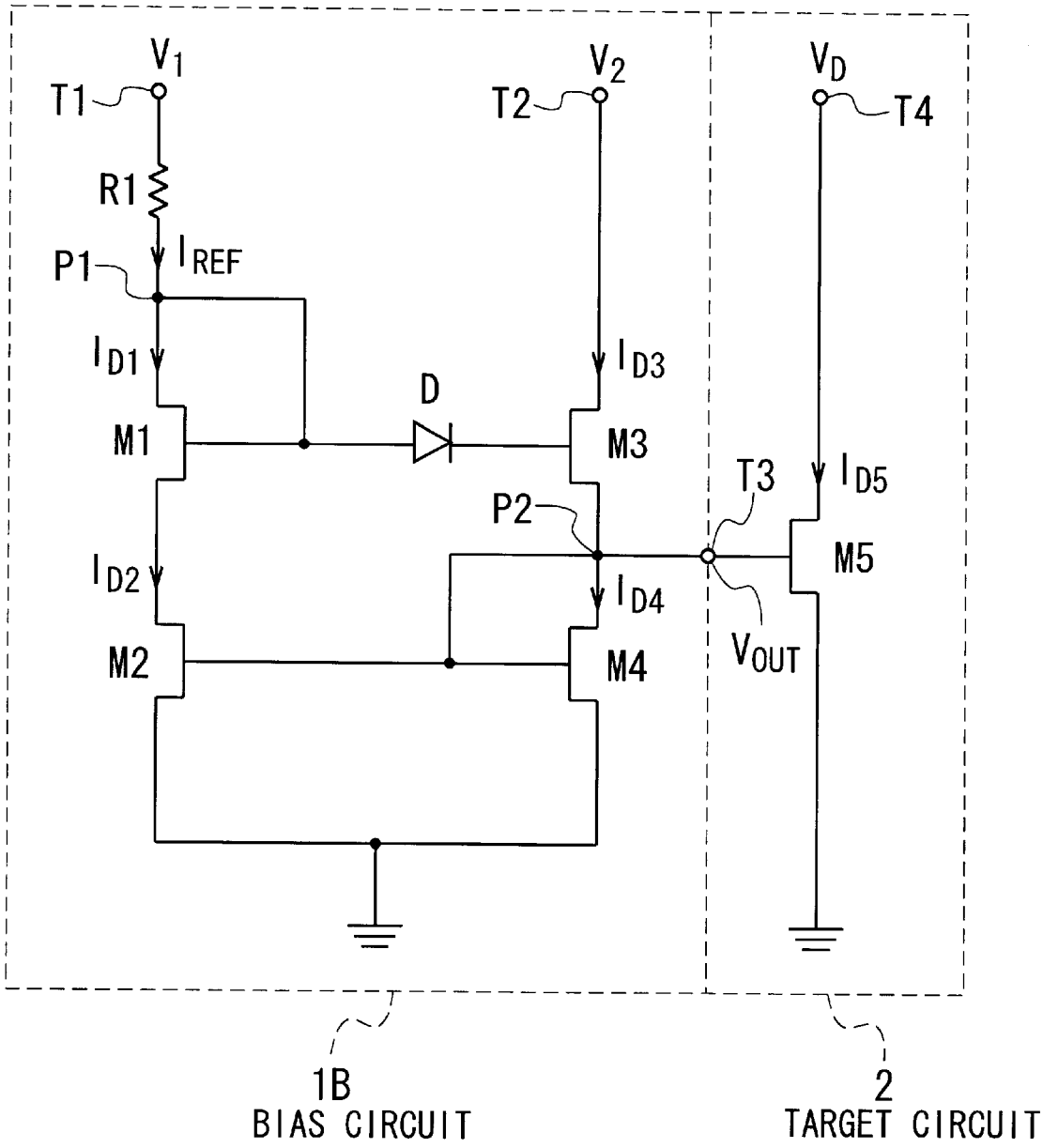
FIG. 4 is a circuit diagram showing the configuration of an active bias circuit according to a third embodiment of the invention.

FIG. 4 shows an active bias circuit 1B according to a third embodiment of the invention, which comprises the same configuration as the circuit 1 according to the first embodiment of FIG. 2, except that the p-n junction diode D is connected between the gates of the MOSFETs M1 and M3. Therefore, the description about the same configuration is omitted here by attaching the same reference symbols as those in the first embodiment for the sake of simplification of description in FIG. 4.

The operation of the active bias circuit 1B according to the third embodiment of FIG. 4 is as follows.

In the same way as that of the first embodiment, the value of the reference resistor R1 is suitably determined or adjusted according to the specific value of the reference voltage $V_1$ (e.g., 2V), setting the value of the reference current $I_{REF}$ flowing through the MOSFET M1 as desired. Due to the reference current $I_{REF}$ thus set, the value of the voltage $V_{P1}$ at the connection point P1 is determined. In the circuit 1B of the third embodiment, the anode and cathode of the diode D are connected to the gates of the MOSFETs M1 and M3, respectively. Thus, a leakage current flows through the diode D from the gate of the MOSFET M1 to the gate of the MOSFET M3, resulting in a forward voltage drop $V_{FD}$. Accordingly, the gate voltage of the MOSFET M3 is lower than the gate voltage of the MOSFET M1 by the value of the voltage drop $V_{FD}$, thereby decreasing the voltage $V_{P2}$ at the point P2 (i.e., the output bias voltage $V_{OUT}$ at the output terminal T3) by the forward voltage drop $V_{FD}$ compared with the conventional bias circuit 10. This relationship is expressed by the following equation (5).

$$V_{OUT} = V_{P2} - V_{FD} \quad (5)$$
$$= V_2 - (V_{FM3} + V_{FD})$$

As clearly seen, the equation (5) is equal to the equation (2) appeared in the first embodiment. Thus, the active bias circuit 1B according to the third embodiment has the same advantages as those in the first embodiment.

A concrete example of the bias circuit 1B is as follows, which was confirmed by the inventor's test.

When the reference voltage $V_1$ is set at 0.2V and at the same time, the bias voltage $V_2$ and the voltage $V_D$ for the MOSFET M5 are set at 4V (i.e., $V_1$=0.2V, $V_2$=$V_D$=4V), the voltage $V_{P1}$ at the point P1 is approximately 0.1V. When the forward voltage drop $V_{FD}$ of the diode D is approximately 0.5V, even if the reference voltage $V_1$ is unable to be lowered to a value lower than approximately 0.2V, the drain current $I_{D5}$ of the MOSFET M5 can be set at 0V, thereby cutting the MOSFET M5 off.

Fourth Embodiment

Figure 5:
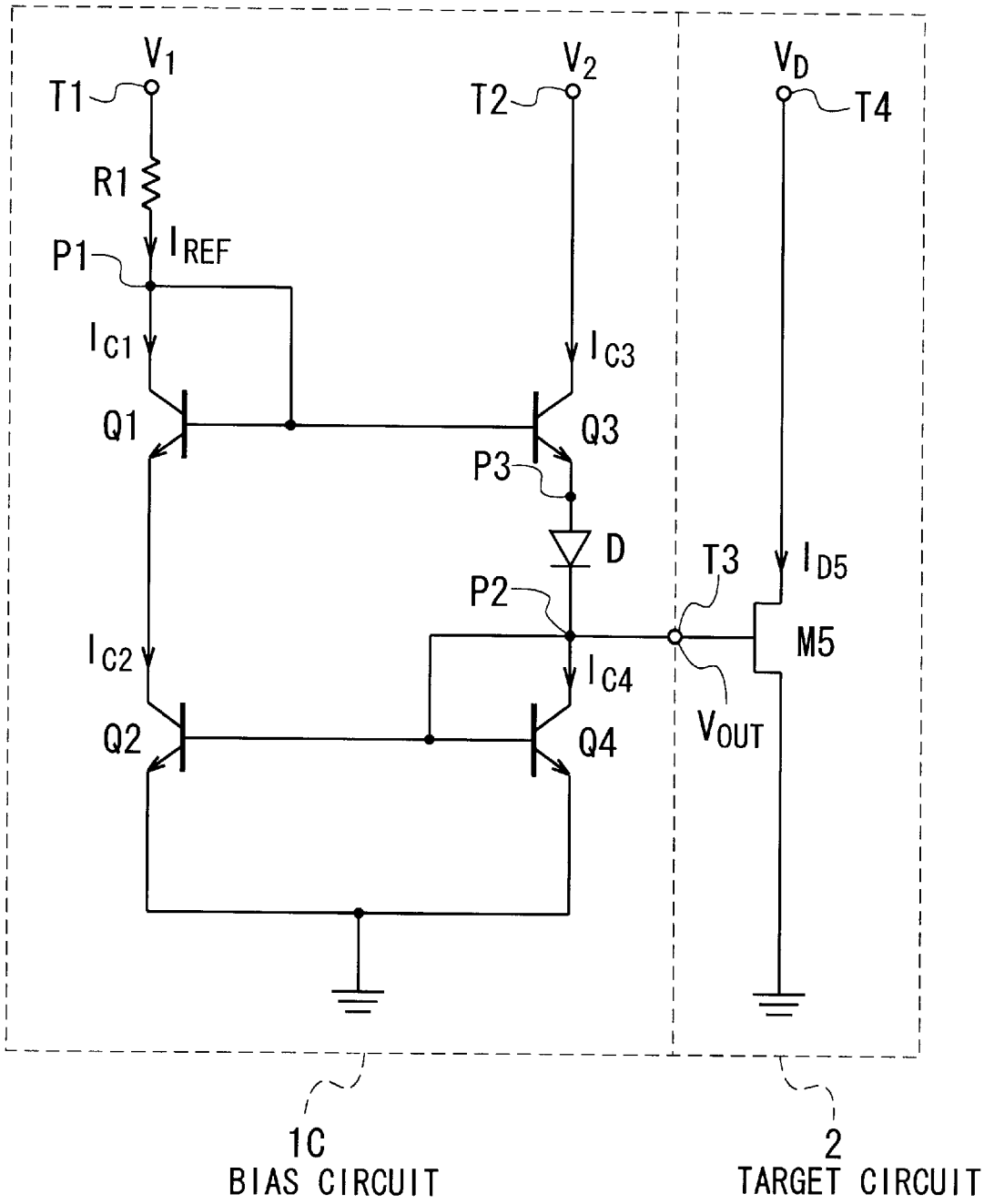
FIG. 5 is a circuit diagram showing the configuration of an active bias circuit according to a fourth embodiment of the invention.

FIG. 5 shows an active bias circuit 1C according to a fourth embodiment of the invention, which comprises the same configuration as the circuit 1 according to the first embodiment of FIG. 2, except that the n-channel MOSFETs M1, M2, M3, and M4 are replaced with npn bipolar transistors Q1, Q2, Q3, and Q4, respectively. Therefore, the description about the same configuration is omitted here by attaching the same reference symbols as those in the first embodiment in FIG. 5.

In FIG. 5, $I_{C1}$, $I_{C2}$, $I_{C3}$, and $I_{C4}$ are collector currents of the transistors Q1, Q2, Q3, and Q4, respectively.

The active bias circuit 1C according to the fourth embodiment operates in substantially the same way as the first embodiment. Therefore, the circuit 1C has the same advantages as those in the first embodiment.

Fifth Embodiment

Figure 6:
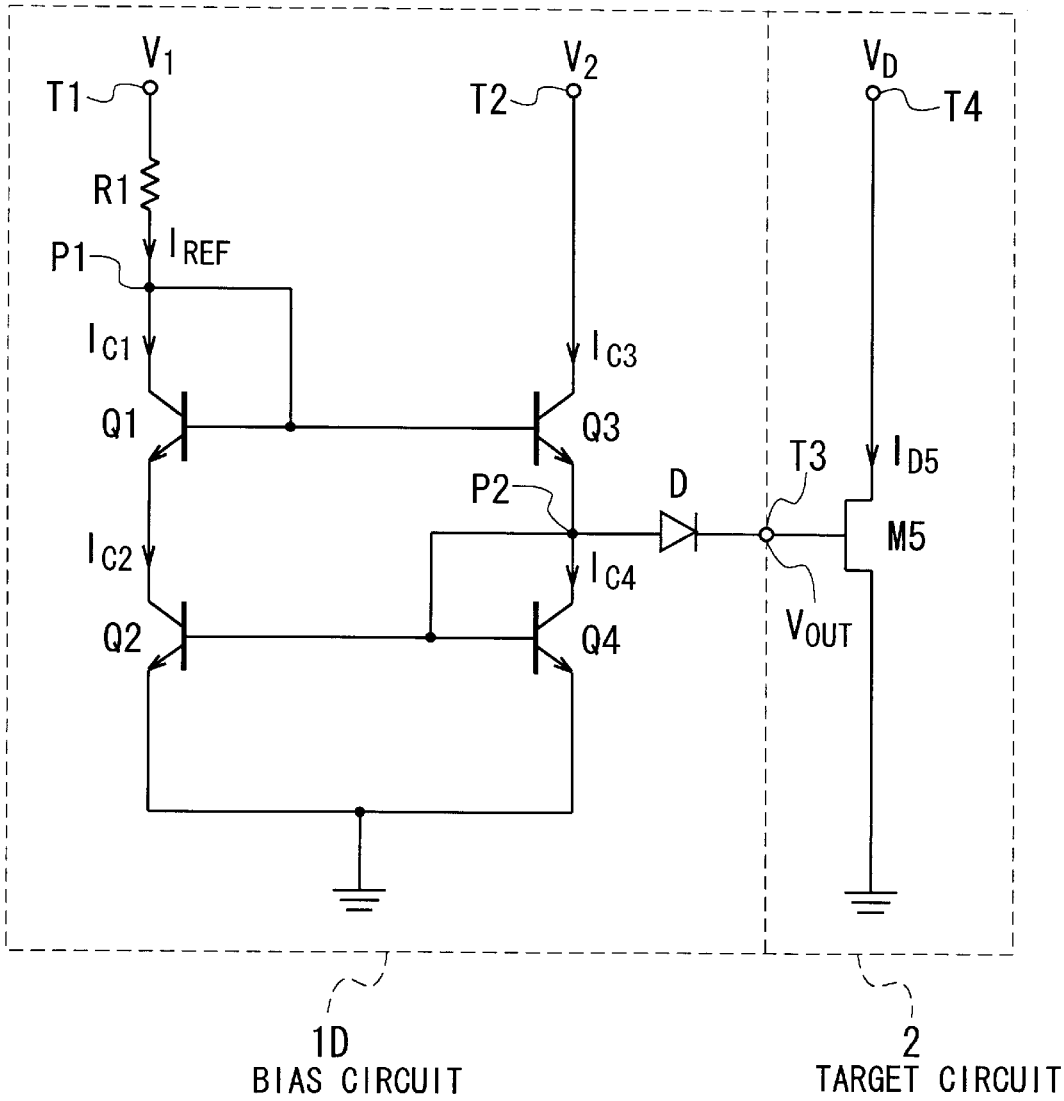
FIG. 6 is a circuit diagram showing the configuration of an active bias circuit according to a fifth embodiment of the invention.

FIG. 6 shows an active bias circuit 1D according to a fifth embodiment of the invention, which comprises the same configuration as the circuit 1A according to the second embodiment of FIG. 3, except that the n-channel MOSFETs M1, M2, M3, and M4 are replaced with npn bipolar transistors Q1, Q2, Q3, and Q4, respectively. Therefore, the description about the same configuration is omitted here by attaching the same reference symbols as those in the second embodiment in FIG. 6.

The active bias circuit 1D according to the fifth embodiment operates in substantially the same way as the first embodiment. Therefore, the circuit 1D has the same advantages as those in the first embodiment.

Sixth Embodiment

Figure 7:
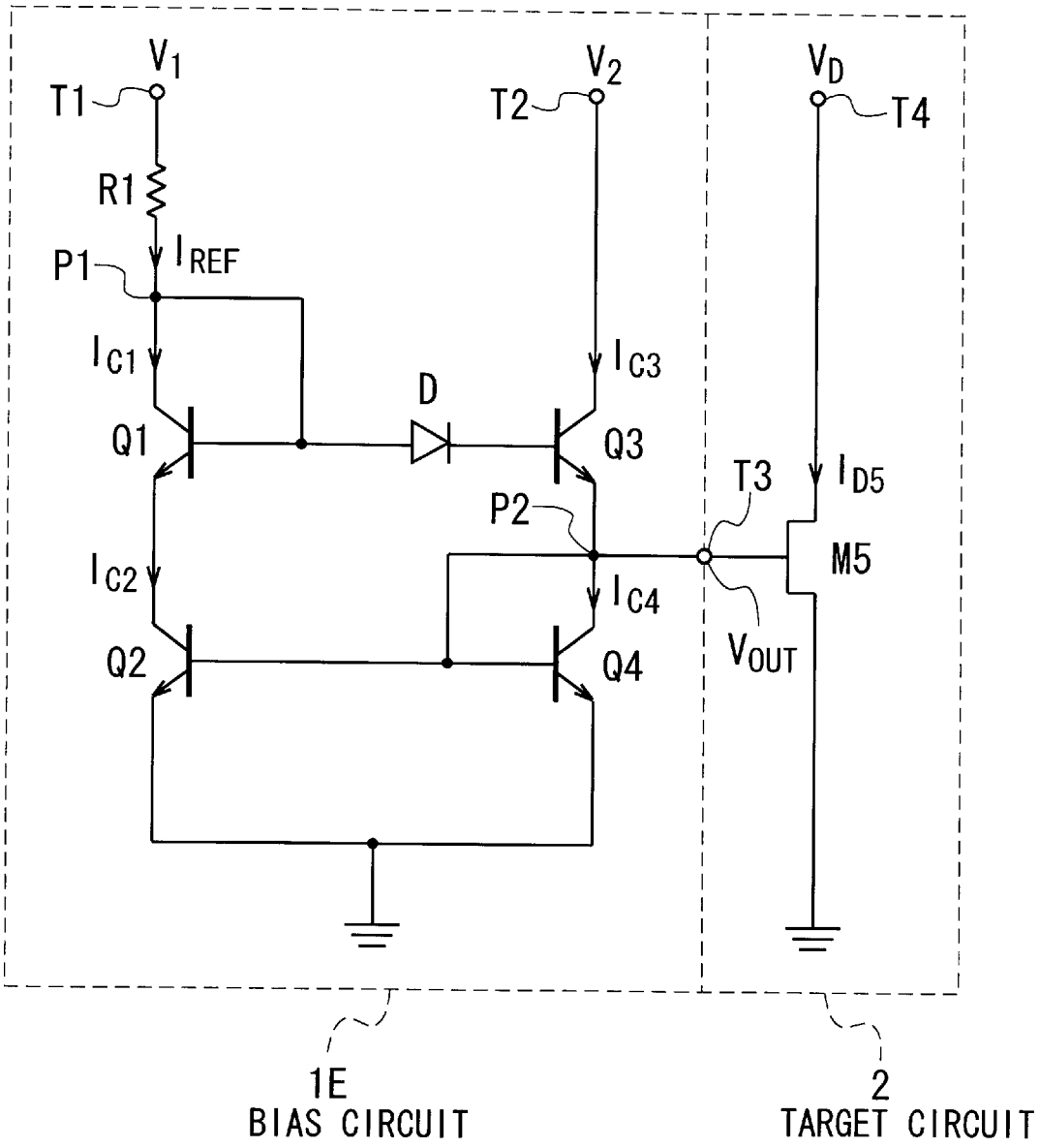
FIG. 7 is a circuit diagram showing the configuration of an active bias circuit according to a sixth embodiment of the invention.

FIG. 7 shows an active bias circuit 1E according to a sixth embodiment of the invention, which comprises the same configuration as the circuit 1B according to the third embodiment of FIG. 4, except that the n-channel MOSFETs M1, M2, M3, and M4 are replaced with npn bipolar transistors Q1, Q2, Q3, and Q4, respectively. Therefore, the description about the same configuration is omitted here by attaching the same reference symbols as those in the third embodiment in FIG. 7.

With the active bias circuit 1E according to the sixth embodiment, unlike circuit 1B of the third embodiment, a base current flows through the diode D from the base of the transistor Q1 to the base of the transistor Q3. Thus, this base current generates the forward voltage drop $V_{FD}$ of the diode D. Therefore, the circuit 1E has the same advantages as those in the first embodiment.

Variations

Needless to say, the invention is not limited to the above-described first to sixth embodiments. For example, although a p-n junction diode is used as the diode D in these embodiments, any other type of diode such as a Schottky barrier diode may be used for this purpose if it generates a specific forward voltage drop $V_{FD}$. The value of the forward voltage drop $V_{FD}$ may be changed or kept constant. For example, with ordinary p-n junction diodes, the value of the forward voltage drop $V_{FD}$ varies according to the change of value of the current. Unlike this, with Schottky barrier diodes, the value of the forward voltage drop $V_{FD}$ is kept constant independent of the change of value of the current.

Instead of the MOSFETs M1 to M4, any other type of FETs such as Metal-Semiconductor FETS (MESFETs) may be used. It is needless to say that the n-channel FETs may be replaced with p-channel FETs and that npn bipolar transistors may be replaced with pnp bipolar transistors.

Furthermore, although the output bias voltage $V_{OUT}$ is applied to the gate of the MOSFET M5 in the target circuit 2 in the above embodiments, the invention is not limited to this case. Any other active element or device may be used if it is of the enhancement type and the voltage-driven type. Any other elements may be provided in the target circuit 2 along with the voltage-driven, active element of the enhancement type.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. An active bias circuit comprising:

(a) a first transistor with a diode connection; the first transistor being supplied with a reference current by way of a resistor;

the reference current being generated by a variable reference voltage applied to the first transistor through a first terminal and the resistor;

the first transistor having a control terminal;

(b) a second transistor connected in cascode to the first transistor;

the second transistor having a control terminal;

(c) a third transistor having a control terminal connected to the control terminal of the first transistor;

a constant current flowing through the third transistor, having a specific ratio with respect to said reference current;

the constant current being generated by a fixed bias voltage applied to a third transistor through a second terminal;

(d) a fourth transistor with a diode connection;

the fourth transistor being connected in cascode to the third transistor;

the fourth transistor having a control terminal connected to the control terminal of the second transistor;

(e) an output terminal formed between the third and fourth transistors connected in cascode;

an output bias voltage being derived from the output terminal;

the output bias voltage varying according to the variable reference voltage; and (f) a diode with a specific forward voltage drop generated by a current flowing through the diode itself, connected to at least one of said transistors, wherein the diode is connected between the third transistor and the output terminal in such a way that a forward direction of the diode and a direction of the constant current flowing through the third transistor are the same.

2. The circuit according to claim 1, wherein an anode of the diode is connected to the source of the third transistor and a cathode of the diode is connected to the drain of the fourth transistor.

3. An active bias circuit comprising:

(a) a first transistor with a diode connection; the first transistor being supplied with a reference current by way of a resistor;

the reference current being generated by a variable reference voltage applied to the first transistor through a first terminal and the resistor;

the first transistor having a control terminal;

(b) a second transistor connected in cascade to the first transistor;

the second transistor having a control terminal;

(c) a third transistor having a control terminal connected to the control terminal of the first transistor;

a constant current flowing through the third transistor, having a specific ratio with respect to said reference current;

the constant current being generated by a fixed bias voltage applied to a third transistor through a second terminal;

(d) a fourth transistor with a diode connection;

the fourth transistor being connected in cascode to the third transistor;

the fourth transistor having a control terminal connected to the control terminal of the second transistor;

(e) an output terminal formed between the third and fourth transistors connected in cascode;

an output bias voltage being derived from the output terminal;

the output bias voltage varying according to the variable reference voltage; and (f) a diode with a specific forward voltage drop generated by a current flowing through the diode itself, connected to at least one of said transistors, wherein the diode is connected between the control terminal of the first transistor and the control terminal of the third transistor is such a way that a forward direction of the diode and a direction of current flowing between the control terminals of the first and third transistors are the same.

4. An active bias circuit comprising:

(a) a first transistor with a diode connection;

the first transistor being supplied with a reference current by way of a resistor;

the reference current being generated by a variable reference voltage applied to the first transistor through a first terminal and the resistor;

the first transistor having a control terminal;

(b) a second transistor connected in cascode to the first transistor;

the second transistor having a control terminal;

(c) a third transistor having a control terminal connected to the control terminal of the first transistor;

a constant current flowing through the third transistor, having a specific ratio with respect to said reference current;

the constant current being generated by a fixed bias voltage applied to a third transistor through a second terminal;

(d) a fourth transistor with a diode connection:

the fourth transistor being connected in cascode to the third transistor; the fourth transistor having a control terminal connected to the control terminal of the second transistor;

(e) an output terminal formed between the third and fourth transistors connected in cascode;

an output bias voltage being derived from the output terminal; the output bias voltage varying according to the variable reference voltage; and (f) a diode with a specific forward voltage drop generated by a current flowing through the diode itself, connected to at least one of said transistors, wherein the diode is connected between a connection point of the third and fourth transistors and the output terminal in such a way that a forward direction of the diode and a direction of the constant current flowing through the third transistor are the same.

* * * * *